US005232051A

United States Patent [19]

Daly

[11] Patent Number: 5,232,051

[45] Date of Patent: Aug. 3, 1993

[54] OIL RECOVERY APPARATUS

[75] Inventor: LeGrand A. Daly, South Bend, Ind.

[73] Assignee: L. A. Daly Company, South Bend, Ind.

[21] Appl. No.: 824,542

[22] Filed: Jan. 23, 1992

[51] Int. Cl.[5] ..... E21B 43/12

[52] U.S. Cl. ..... 166/369; 166/53; 166/67; 166/75.1

[58] Field of Search ..... 166/311, 369, 370, 67, 166/72, 75.1, 53

[56] References Cited

U.S. PATENT DOCUMENTS

| | | | |
|---|---|---|---|
| 3,774,685 | 11/1973 | Rhodes | 166/369 |
| 4,552,220 | 11/1985 | Jones | 166/369 |
| 4,751,969 | 6/1988 | Klaeger | 166/369 |
| 4,962,847 | 10/1990 | Pisors et al. | 166/369 X |
| 5,080,781 | 1/1992 | Evins, IV | 166/369 X |

*Primary Examiner*—George A. Suchfield
*Attorney, Agent, or Firm*—Thomas J. Dodd

[57] ABSTRACT

Apparatus for continuously recovering oil-only from mature wells with typically low production. The apparatus includes a continuous chain which is suspended in the oil-containing portion of the well. By continuously moving the chain, oil is drawn out of the well and deposited in a collection box.

14 Claims, 3 Drawing Sheets

OIL RECOVERY APPARATUS

FIELD OF THE INVENTION

This invention relates to oil recovery and will have special application to apparatus for recovering oil from mature, low production wells.

BACKGROUND OF THE INVENTION

Current methods and devices for recovering oil from mature, low production wells require the withdrawal of large amounts of brine along with the oil. Such methods erode the subsurface oil-bearing reservoirs and result in the well eventually ceasing to produce economic quantities of oil. Also, the brine removed from the well must be disposed of at the expense of the well proprietor.

A number of devices have been introduced which only incidentally purport to recover oil non-continuously from a well, while leaving the brine. So-called oil-only recovery systems are generally not practical for the majority of the well casings which are usually less than 6½ inches in diameter. Other devices have also been used which are complicated, costly and require format maintenance. These devices are shown in U.S. Pat. Nos. 3,774,685; 4,962,847; 4,962,847; 4,712,667; 1,007,282; 4,542,787; 4,522,220; 4,716,962; 4,683,946; and 4,166,830.

SUMMARY OF THE INVENTION

The continuous oil-only recovery device and apparatus of this invention includes a continuously driven conveyor chain which hangs in the well borehole and whose lowest point is suspended in the uppermost oil stratum. Since oil is less dense than brine this oil stratum is located at the topmost level of the static fluid column in the borehole.

As the conveyor chain passes through the oil stratum, oil is attracted to the links of the chain by capillary, electrical or chemical attraction and carried thereby to the surface. The oil-laden conveyor chain passes over a primary drive pocket pulley and through a wiping device which scrubs the oil off of the chain after which the oil falls by gravity into a collection reservoir. As this oil is lifted off the column, continuous oil migration from the associated external oil-bearing reservoir replaces it by force of the oil brine gravity differential to be drawn off by the continuous passage of the conveyor chain.

Accordingly, it is an object of this invention to provide for a continuous oil-only recovery apparatus which is designed to enhance and beneficially extend the economic life of mature, low production wells.

Another object is to provide for a continuous oil-only recovery apparatus which reduces or eliminates the production of brine.

Another object is to provide for a continuous oil-only recovery apparatus which can run continuously with very little manpower, energy and maintenance expenditures.

Still another object is to provide for a continuous oil-only recovery apparatus which is economical and practical for use in mature, relatively low production wells.

Still another object is to provide for a continuous oil recovery apparatus which gently lifts oil directly from the uppermost stratum thereby allowing the static fluid column to attempt to regain its oil-brine equilibrium, gently, which lengthens the production life cycle of the well and its external associated oil-bearing reservoir.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

Figure 1:
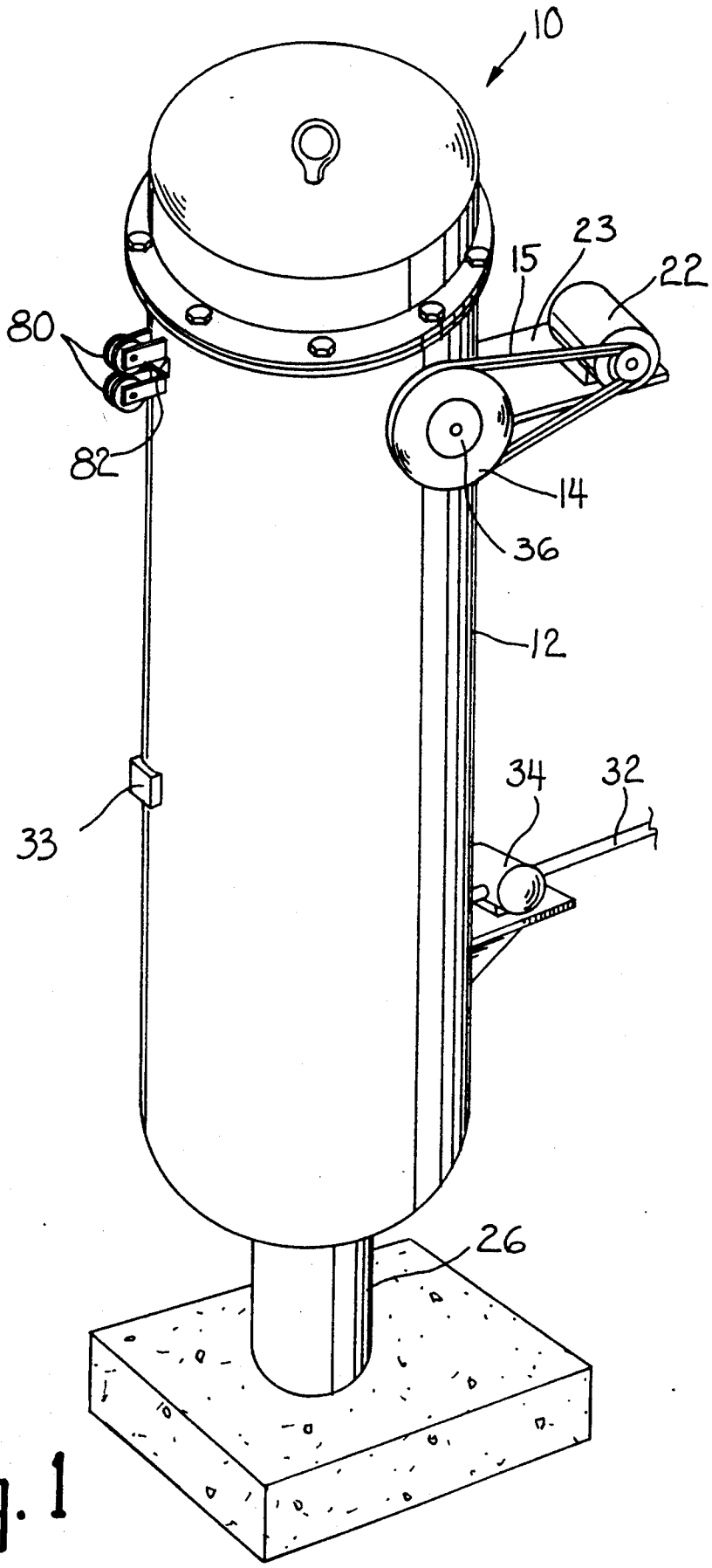
FIG. 1 is a perspective view of the above ground portion of the oil recovery apparatus in use.

The preferred embodiment herein described is not intended to be exhaustive or to limit the invention to the precise form disclosed. It is chosen and described to explain the principles of the invention and its application and practical use so others skilled in the art may utilize the teachings.

Referring now to the drawings, reference numeral 10 refers generally to the continuous oil-only recovery apparatus of this invention. Recovery apparatus 10 is adapted generally for use with mature, relatively low product oil wells, but may be used in almost any relatively shallow oil well which has a multilayered static fluid column.

Recovery apparatus 10 includes generally enclosed frame 12, pocket drive pulley 14, driven pulley 13, idler pulleys 16, 18, wiping device 20 and motor 22. Frame 12 is preferably tubular as shown in the FIG. 1, and is fastened to the well head 26 as by bolts, threads or other conventional means. Frame 12 also includes oil collection reservoir 30 which is connected via outlet line 32 to a storage tank (not shown). Pump 34 is in communication with line 32 and serves to impel oil in reservoir 30 to the storage tank.

Figure 2:
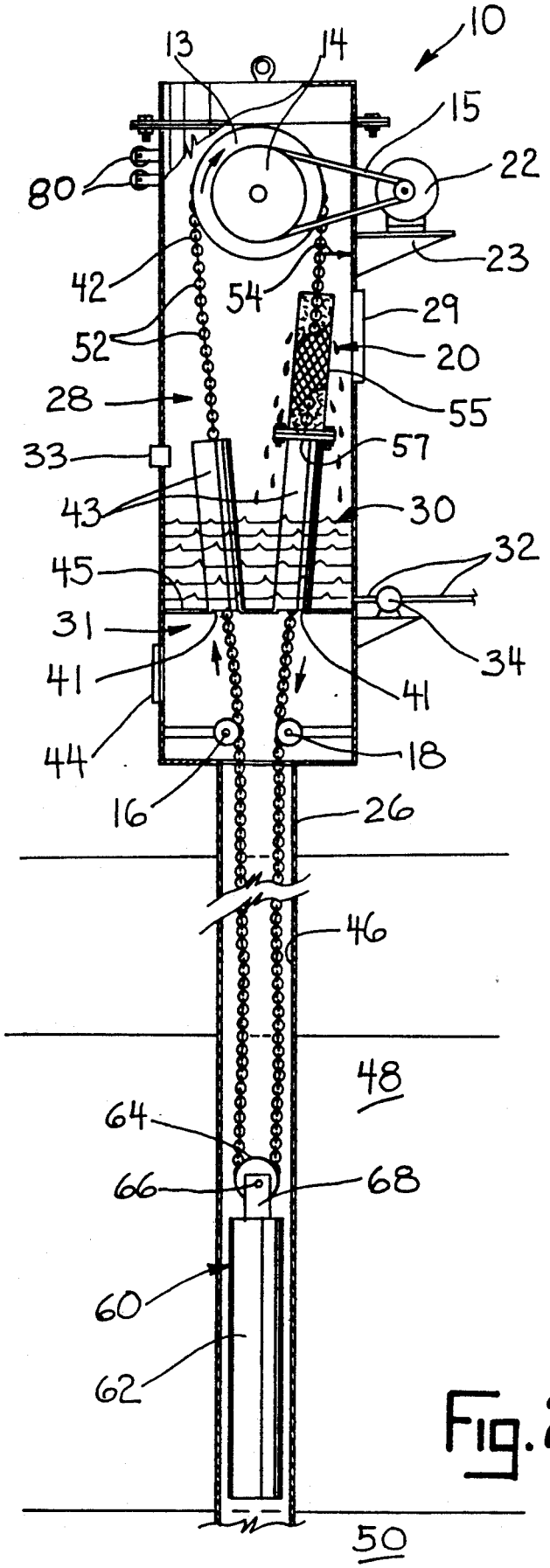
FIG. 2 is a fragmented vertical section view of the apparatus.

As shown in FIG. 2, frame 12 is completely enclosed and defines three separate and distinct chambers, namely upper pulley chamber 28 and reservoir 30 and lower idling chamber 31. Pulley chamber 28 houses drive pulley 14 and wiping device 20 as shown. A service hatch spanned by access door 29 provides for maintenance access into chamber 28.

Wall 45 separates chambers 30 and 31 and includes holes 41 to allow free passage of chain 42. Tubes 43 cover holes 41 to seal chamber 30 against oil leakage.

Wall 45 separates chambers 30 and 31 as shown. A pair of opposed idler pulleys 16, 18 are housed in chamber 31 as shown. Idler pulleys 16, 18 take up slack in chain 42 as the chain is drawn across the pulleys to help prevent binding and to prevent the chain from touching the walls of well casing 46 which could cause loss of oil and chain and casing wear. Maintenance of chamber 31 is possible through service hatch 44.

Motor 22 is preferably a conventional electric motor and is connected to frame 12 through motor mounting bracket 23. Motor 22 is mechanically connected as by roller chain 15 to drive sprocket 14 which is housed in bearing block 36 mounted outside frame 12. Motor 22 may include a clutch, gears, shear pins, or other devices (not shown) to regulate the speed of roller chain 15. The construction and operation of motor 22 and bearing block 36 is conventional in nature and will not be described further in the interest of clarity.

Conveyor chain 42 is preferably a high tensile strength metal chain which has multiple articulated links 52 and extends across sprocket 14 as shown. Chain 42 is suspended into the well casing 46 such that the lowermost point of the chain is located in the oil reservoir pay zone 48 above the saturated zone 50 which holds the brine or water portion of the static fluid column. The depth of the zones 48, 50 is predetermined using conventional oil industry procedures, with oil stratum 48 at the uppermost part of the static fluid column due to the lighter density of oil when compared with brine. These procedures, as well as the actual well-drilling procedures have been omitted from this description because they are well known to those skilled in the art.

Chain 42 is preferably formed of high carbon steel and includes multiple articulations 52 which are precisely calibrated for uniform link geometry and weldments. In addition, in order to ensure continuous chain movement with minimum wear, the weldments should be oriented such that they face outwardly (in the direction of arrow 54) as the chain enters the downhole turn off drive pulley 14.

In order to prevent chain 42 from binding in the relatively narrow (six inches or less) well casing 46, the chain is connected to a downhole sheave 60. Sheave 60 includes a weight 62 which is preferably calibrated to compensate for the length of chain necessary to reach the oil stratum 48. For example, it has been found that approximately one hundred pounds of weight will properly balance each five hundred feet of chain to prevent binding. Sheave 60 also includes grooved roller 64 which is rotatably attached to weight 62 by axle 66 spanning U-shaped bracket 68. Chain 42 rides across grooved roller 64 as it is pulled through oil stratum 48.

Chain 42 may be treated in a variety of fashions in order to enhance its affinity for oil. Some treatment methods include sand/shot blasting, electrical charging, chemical conversion oxide formation and the addition of lipophilic compounds to the chain 42. The treatment of chain 42 is desirable to minimize the loss of oil falling from the chain under the influence of gravity and shear as the chain travels upwardly through well casing 46 towards frame 12.

Figure 3:
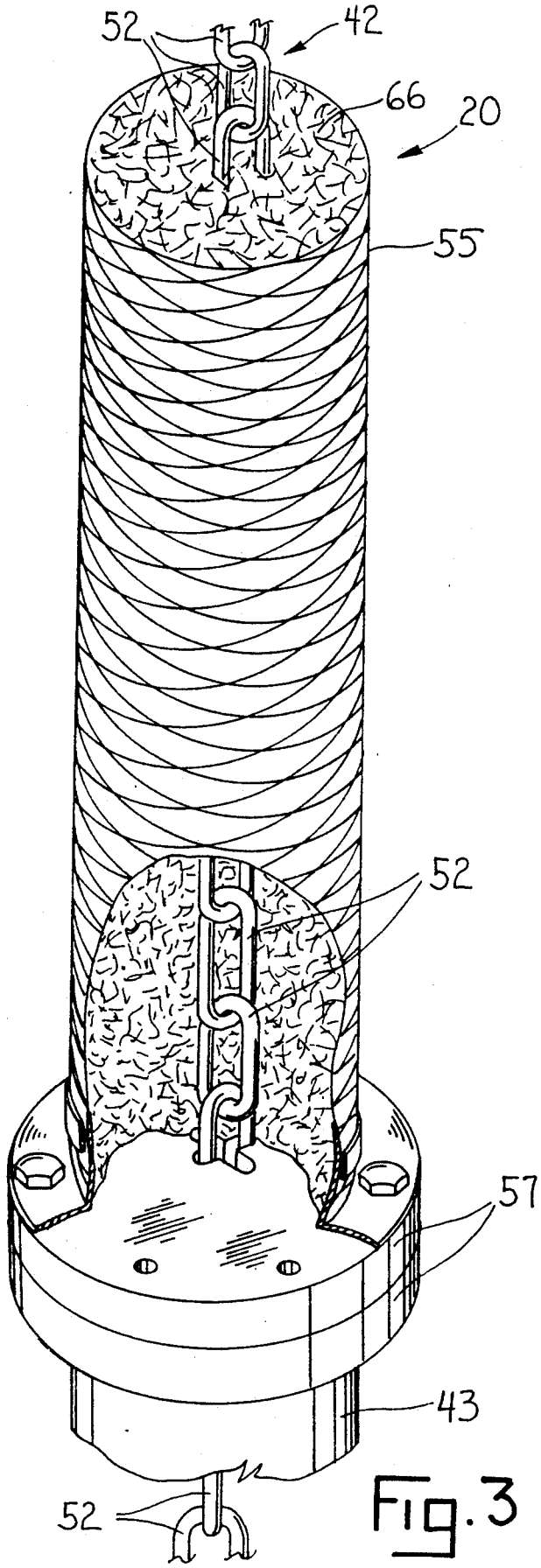
FIG. 3 is a perspective view of the wiping device with portions cut away for illustrative purposes.

Wiping device 20 is positioned in and mounted to frame 12 chamber 28. Wiping device 20 as shown in FIG. 3 is preferably a hollow tube 55 which includes steel wool canister 56 or its equivalent. A series of washers 57 seals tube 55 and wall 38 to prevent oil from tube 55 to leak into tube 43 and back into the well casing. Oil scrubbed from chain 42 runs down tube 43 into reservoir 30 from where it can be collected.

Oil recovery apparatus 10 is installed and operated as follows. After the depth of the uppermost oil pay zone 48 has been established, frame 12 is connected to well head 26 in a conventional manner. Chain 42, whose length has been precisely calculated to drop directly into oil stratum 48, is run between rollers 80 through frame hole 82 across pulley 14, through wiping device 20 and across sheave roller 64 so that all chain weldments are oriented in the same direction (outward-facing as described above).

Motor 22 is then activated to turn drive sprocket 14 and circulate chain 42 continuously across pulley 13, wiping device 20 and down into the well casing 46 across roller 64 and back up into frame 12 across pulley 14. As the chain 42 passes through pay zone 48, the lipophilic nature of the chain (enhanced perhaps by one of the above treatment methods) causes oil in the oil stratum to attach to the chain and be drawn upwardly therewith. The oil is scrubbed off chain 42 as it passes through wiping device 20 and falls into oil collection reservoir 30. Reservoir 30 may be equipped with a sensor such as a float 33 which activates an on delay relay mechanism on pump 34 when the oil level in the reservoir reaches a predetermined level. Pump 34, when activated, impels oil in reservoir 30 to a storage tank (not shown).

As oil is drawn off from the oil stratum 48, it is continuously replaced by migrating oil from external associated saturated zone 50 due to gravity differential. Since the lowest point of drop in chain 42 is in the oil bearing stratum 48, and above the oil reservoir zone 50, only oil is carried upward by chain 42. This maintains the hydrostatic and gravitational equilibrium in well casing 46 to allow the upward migration of lower gravity oil supplies without further eroding the earth strata of the external associated oil-bearing reservoir.

It should be noted that pulleys 14, 16, 18 and wiping device 20 are preferably fully enclosed in frame 12 to allow uninterrupted use of apparatus 10 under all weather conditions. Apparatus 10 may also be equipped with safety devices which would shut off the motor in the event of a malfunction, such as overloading of binding of chain 42.

It is understood that the invention is not limited to the given details, but may be modified within the scope of the following claims.

I claim:

1. Apparatus for recovering oil from a borehole which extends into an oil-bearing stratum of a static fluid column, said apparatus comprising a frame, a rotatable wheel housed in said frame, a continuous conveyor chain extending across said rotatable wheel, said chain having its lowest drop point located in an uppermost fluid column oil-bearing stratum in said borehole, motor means attached to said frame for causing rotation of said rotatable wheel wherein said conveyor chain is continuously pulled through said uppermost fluid column oil-bearing stratum, said chain constituting means for continuously attracting oil from the uppermost fluid column stratum and carrying said oil upwardly out of said borehole, scouring means associated with said frame for removing said oil from said chain, and means associated with said frame for collecting said oil after removal from the chain.

2. Apparatus of claim 1 wherein said conveyor chain includes a plurality of articulated chain links, said links including weldments, each weldment oriented facing outwardly of said frame.

3. Apparatus of claim 1 wherein said apparatus further includes first and second idler pulleys rotatably connected to said frame spaced from said rotatable wheel.

4. Apparatus of claim 3 wherein said scouring means includes a canister packed with scouring material located between said rotatable wheel and one of said first and second idler pulleys, said chain passing through said canister and contacted by said scouring material.

5. Apparatus of claim 4 wherein said scouring material is steel wool.

6. Apparatus of claim 1 wherein said means for collecting includes a reservoir located beneath said rotatable wheel and said scouring means, and means for pumping said oil out of said reservoir to a storage area.

7. Apparatus of claim 6 and further including sensor means positioned in said reservoir for actuating said means for pumping upon said oil reaching a predetermined level in said pan.

8. Apparatus of claim 1 and a sheave positioned in the uppermost stratum of said borehole, said sheave including a weight suspended from a rotatable roller and extending further downward into said borehole, said chain extending across said roller.

9. In combination, an oil well having a static fluid column, and apparatus for continuously removing oil-only from said static fluid column, said oil well including a borehole, a well casing in said borehole, said well casing terminating in an above-ground well head, said static fluid column including an uppermost stratum containing oil and an underlying zone containing brine, said apparatus including a frame coupled to said well head, said frame having first walls extending generally vertically upward from said well head to define a continuation of said borehole, said frame further including second walls laterally spaced from said well head, a rotatable pulley housed in said frame, motor means for rotating said pulley, a conveyor chain seated in said pulley, said chain of sufficient length so as to be freely suspended into said borehole and having its lowest point of drop located in said uppermost stratum wherein said chain is pulled through said uppermost stratum upon actuation of said motor means, said chain constituting means for attracting oil in said uppermost stratum wherein said oil attached to said chain is drawn up with the chain into said frame, scouring means housed in said frame for removing said oil from said chain, said frame second walls defining reservoir means for collecting the oil removed from the chain by said scouring means.

10. The combination of claim 9 wherein said scouring means includes a canister packed with steel wool.

11. The combination of claim 9 wherein said reservoir means includes a reservoir located beneath said rotatable wheel and said scouring means, and means for pumping said oil out of said reservoir to a storage area.

12. The combination of claim 11 and further including sensor means positioned in said reservoir for actuating said means for pumping upon said oil reaching a predetermined level in said pan.

13. A method of recovering oil from a borehole comprising the steps of:

a) providing a lipophilic continuous articulated conveyor chain connected to a drive sprocket;

b) providing means for turning said drive sprocket;

c) measuring said chain for length so that when lowered into said borehole its lowest point of drop is located in an uppermost fluid column stratum in said borehole;

d) rotating said drive sprocket to continuously draw said chain through said uppermost fluid column wherein oil is drawn upwardly from said borehole on said chain;

e) providing an above ground collection reservoir for holding said oil and drawing said chain through said reservoir;

f) providing scouring means for continuously scrubbing said oil from said chain in said reservoir; and pulling said chain through said scouring means to remove said oil from said chain for collection in said reservoir.

14. The method of claim 13 wherein step c) includes lowering said chain into said borehole while connected to a weighted sheave.

* * * * *